US010830554B1

(12) United States Patent
Jones

(10) Patent No.: US 10,830,554 B1
(45) Date of Patent: Nov. 10, 2020

(54) ARCHERY RELEASE

(71) Applicant: H.I.T. Outdoors, LLC, Clay City, KY (US)

(72) Inventor: Brian K. Jones, Georgetown, KY (US)

(73) Assignee: H.I.T. Outdoors, LLC, Clay City, KY (US)

( * ) Notice: Subject to any disclaimer, the term of this patent is extended or adjusted under 35 U.S.C. 154(b) by 0 days.

(21) Appl. No.: 16/686,849

(22) Filed: Nov. 18, 2019

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS

| | | | | |
|---|---|---|---|---|
| 228,302 A | | 6/1880 | Beard | |
| 229,089 A | | 6/1880 | Burnham | |
| 3,853,111 A | * | 12/1974 | Stanislawski | F41B 5/1469 124/35.2 |
| 3,965,884 A | * | 6/1976 | Killian | F41B 5/1469 124/35.2 |
| 4,036,204 A | | 7/1977 | Scott | |
| 4,041,926 A | | 8/1977 | Troncoso et al. | |
| 4,160,437 A | | 7/1979 | Fletcher | |
| 4,324,222 A | * | 4/1982 | Gasser | F41B 5/1426 124/89 |
| 4,509,497 A | | 4/1985 | Garvison | |
| 4,539,968 A | | 9/1985 | Garvison | |
| 4,567,875 A | | 2/1986 | Fletcher | |
| 4,574,767 A | | 3/1986 | Gazzara | |
| 4,620,523 A | | 11/1986 | Peck | |
| 4,674,469 A | | 6/1987 | Peck | |
| 4,854,293 A | | 8/1989 | Roberts | |

(Continued)

FOREIGN PATENT DOCUMENTS

WO 2018075590 A1 4/2018

OTHER PUBLICATIONS

Various prior art releases (1) downloaded from http://www.archeryhistory.com/releases/releasespics/release4.jpg on Dec. 29, 2009.

(Continued)

*Primary Examiner* — Alexander R Niconovich
(74) *Attorney, Agent, or Firm* — Warner Norcross + Judd LLP

(57) ABSTRACT

An archery release is provided including a digit extension attached to a handle via a spindle connection that facilitates configuration of the extension in multiple, set, nonrotatable orientations relative to the handle to fulfill an archer's preferences. The handle can include an arm that extends to a release head having a sear defining a bowstring notch. The spindle connection can join the handle and digit extension, and can include a spindle post having multiple ridges, and a spindle recess having multiple valleys configured to receive corresponding ones of the ridges to prevent rotation of the digit extension relative to the handle in a registration mode. In an adjustment mode, the digit extension and part of the spindle connection can be removed, rotated and replaced relative to another part of the spindle connection to adjust the position of the extension to an archer's preferences.

18 Claims, 5 Drawing Sheets

(56) References Cited

U.S. PATENT DOCUMENTS

| | | | | |
|---|---|---|---|---|
| 4,881,516 | A | 11/1989 | Peck | |
| 5,009,214 | A | 4/1991 | Wilde | |
| 5,025,772 | A | 6/1991 | Stevenson | |
| 5,205,268 | A | 4/1993 | Savage | |
| 5,261,581 | A | 11/1993 | Harden | |
| 5,273,021 | A | 12/1993 | Tepper | |
| 5,323,754 | A | 6/1994 | Pittman et al. | |
| 5,448,983 | A | 9/1995 | Scott | |
| 5,546,924 | A | 8/1996 | Todd | |
| 5,595,167 | A | 1/1997 | Scott | |
| 5,596,977 | A | 1/1997 | Scott | |
| 5,685,286 | A | 11/1997 | Summers | |
| 5,692,490 | A * | 12/1997 | Walker | F41B 5/1469 124/35.2 |
| 5,694,915 | A * | 12/1997 | Summers | F41B 5/1469 124/35.2 |
| 5,765,536 | A | 6/1998 | Scott | |
| 5,803,068 | A | 9/1998 | Summers | |
| 5,850,825 | A | 12/1998 | Scott | |
| 5,937,842 | A * | 8/1999 | Summers | F41B 5/1469 124/35.2 |
| 6,032,661 | A | 3/2000 | Goff et al. | |
| 6,205,991 | B1 * | 3/2001 | Summers | F41B 5/1469 124/35.2 |
| 6,571,786 | B2 * | 6/2003 | Summers | F41B 5/1469 124/35.2 |
| 6,631,709 | B2 | 10/2003 | Carter et al. | |
| 6,736,124 | B2 * | 5/2004 | Carter | F41B 5/1469 124/35.2 |
| 6,895,951 | B2 | 5/2005 | Summers et al. | |
| 6,945,241 | B2 * | 9/2005 | Pellerite | F41B 5/1469 124/35.2 |
| 6,953,035 | B1 | 10/2005 | Summers et al. | |
| 7,654,254 | B1 * | 2/2010 | Rentz | F41B 5/1469 124/35.2 |
| 7,762,245 | B2 * | 7/2010 | Smith | F41B 5/10 124/25.6 |
| 7,958,881 | B2 * | 6/2011 | Silverson | F41B 5/1426 124/86 |
| 8,622,051 | B2 | 1/2014 | Summers et al. | |
| 9,557,133 | B2 * | 1/2017 | Rentz | F41B 5/1469 |
| 9,612,077 | B2 * | 4/2017 | Kelly | F41B 5/1469 |
| 9,618,295 | B1 * | 4/2017 | Rentz | F41B 5/1469 |
| 9,982,961 | B1 * | 5/2018 | Rentz | F41B 5/1469 |
| 10,281,231 | B2 * | 5/2019 | Springer | F41B 5/1469 |
| 10,436,544 | B1 * | 10/2019 | Jones | F41B 5/1469 |
| 10,731,943 | B2 * | 8/2020 | Horn | F41B 5/1469 |
| 2003/0037778 | A1 * | 2/2003 | Carter | F41B 5/1469 124/35.2 |
| 2004/0079351 | A1 * | 4/2004 | Summers | F41B 5/1469 124/35.2 |
| 2008/0149084 | A1 * | 6/2008 | Whalen | F41B 5/1469 124/35.2 |
| 2009/0090342 | A1 | 4/2009 | Freitag et al. | |
| 2009/0095270 | A1 | 4/2009 | Graves | |
| 2009/0107474 | A1 * | 4/2009 | Silverson | F41B 5/1426 124/23.1 |
| 2010/0108047 | A1 | 5/2010 | Jones | |
| 2011/0168146 | A1 * | 7/2011 | Deceuster | F41B 5/1469 124/35.2 |
| 2011/0259311 | A1 * | 10/2011 | Campbell | F41B 5/1469 124/35.2 |
| 2012/0192844 | A1 * | 8/2012 | Springer | F41B 5/1469 124/35.2 |
| 2012/0285431 | A1 * | 11/2012 | Summers | F41B 5/1469 124/35.2 |
| 2013/0025578 | A1 * | 1/2013 | Jones | F41B 5/1469 124/35.2 |
| 2013/0092140 | A1 * | 4/2013 | Rentz | F41B 5/1469 124/35.2 |
| 2015/0090240 | A1 * | 4/2015 | Kelly | F41B 5/1469 124/35.2 |
| 2015/0090241 | A1 * | 4/2015 | Kelly | F41B 5/1469 124/35.2 |
| 2015/0219418 | A1 * | 8/2015 | Whalen | F41B 5/1469 124/35.2 |
| 2016/0138887 | A1 * | 5/2016 | Kelly | F41B 5/1469 124/35.2 |

OTHER PUBLICATIONS

Various prior art releases (2) downloaded from http://www.archeryhistory.com/releases/releasespics/release4.jpg on Dec. 29, 2009.

Prior art releases (3) downloaded from http://www.archeryhistory.com/releases on Jul. 21, 2011.

Prior art releases (4) downloaded from http://www.archeryhistory.com/releases on Jul. 21, 2011.

Longhorn Hunter (Jan. 2010).

* cited by examiner

ARCHERY RELEASE

BACKGROUND OF THE INVENTION

The present invention relates to an archery release aid, and more particularly to a hand held archery release with a handle.

Conventional archery releases are designed to temporarily hold a bowstring of an archery bow so that an archer can pull on the release and subsequently draw the bowstring to shoot an arrow from the bow. Archery releases typically assist an archer in quickly and cleanly releasing the bowstring. In general, archery releases are intended to consistently release the bowstring when the archer shoots the arrow, and thus increase the accuracy of the shot.

A common type of release used by some archers, and in particular competitive archers, is a hand held release, which is generally held in an archer's hand during a shot sequence. One hand held release is a thumb release, which includes a trigger assembly that is mechanically actuated by a thumb trigger configured to be engaged by a user's thumb. This thumb release can be held in a user's hand with one or more fingers on the handle, while the thumb is positioned over the thumb trigger. To activate the thumb release, the archer engages the thumb trigger, which in turn engages the trigger assembly causing the string hook to pivot and release the bowstring. Another type of hand held release is a back tension release, which also includes a release handle.

To operate this release, an archer holds the handle with one, two or more fingers, and concentrates to squeeze together their shoulder blades, or in other words, "tense their back." Because the archer holds the handle in their hand, the tensed back muscles move the archer's hand, which rotates the release slightly so that the bowstring is released.

Such hand held releases are highly effective at eliminating shot anticipation, which may hinder shot accuracy. With the thumb or back actuating the release, the hand held release aid releases the bowstring somewhat unexpectedly. This typically improves shooting form and shot placement and thereby increases the accuracy of an archer using such releases.

Archers usually have preferences with regard to the spatial orientation of their fingers relative to a handle and/or thumb trigger of such releases to accommodate their physical stature and hand placement. Some manufacturers address this issue by constructing the release with an adjustable swivel between the release head and the handle. This can enable the archer to vary or rotate their hand and digits with the handle and thumb trigger relative to the release head, for example, to accommodate a particular anchor or pull angle. While the rotatable head works for many, it still might not offer the level of customization and hand positioning relative to the release and bowstring that many archers prefer. Other manufacturers thread extra holes in a handle so that an archer can screw parts of a handle together in a particular manner. While multiple screw positions offer some variability to positioning parts of the handle, they do not provide granular and precise adjustments that many archers desire.

Accordingly, there remains room for improvement in connection with the fitment and customization of hand held releases and their components.

SUMMARY OF THE INVENTION

An archery release is provided in the form of a hand held release having a digit or finger extension selectively positionable and securable relative to a release handle via a splined connection.

In one embodiment, the archery release can include can include a release body having a handle, configured to engage an archer's digits, and an arm extending toward and joined with a release head, which can include a release hook. The arm can be configured to be placed between the archer's digits, and can connect the head and the remainder of the handle.

In another embodiment, the release can include the splined connection between the digit extension and the remainder of the handle.

In still another embodiment, the splined connection can include a spline post associated with one of the handle and the extension and a corresponding spline recess defined in the other of the handle and the extension. The spline post can be selectively and nonrotatably received in the spline recess.

In yet another embodiment, the digit extension can include a first fastener hole that extends to and is in communication with the spline recess defined by the extension. A fastener in the fastener hole can extend simultaneously within the first fastener hole and the spline recess, optionally also within the spline post when the spline post is installed in the spline recess.

In still another embodiment, the spline post can include a second fastener hole that is aligned with and in communication with the first fastener hole when the digit extension is installed relative to the remainder of the handle. The fastener can extend in the first and second fastener holes simultaneously to connect the extension to the handle in a nonrotatable, fixed orientation.

In a further embodiment, the first fastener hole can be adjacent a shoulder that separates a first part of the first fastener hole from the spline recess. The shoulder can form a contact surface against which a head of the fastener engages when the fastener is tightened in the first and/or second fastener holes.

In still a further embodiment, the second fastener hole can be threaded, while the first fastener hole is not threaded. The spline post can project from a support surface of a base. The support surface can be adjacent or engage a lower surface of the digit extension when the digit extension is installed relative to the handle.

An efficient archery release is provided that enables an archer to precisely and consistently utilize the release according to the archer's physical stature and performance preferences. When the selectively adjustable finger extension is included, an archer can precisely and consistently adjust the handle configuration and finger placement relative to the release body and the head to the archer's personal preferences and/or to fit the archer's physical stature. Thus, the handle becomes more comfortable to fit and to be grasped by an archer's fingers. With the extension, the handle can be customized to release more or less quickly, depending on the setting of the extension relative to the remainder of the handle.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
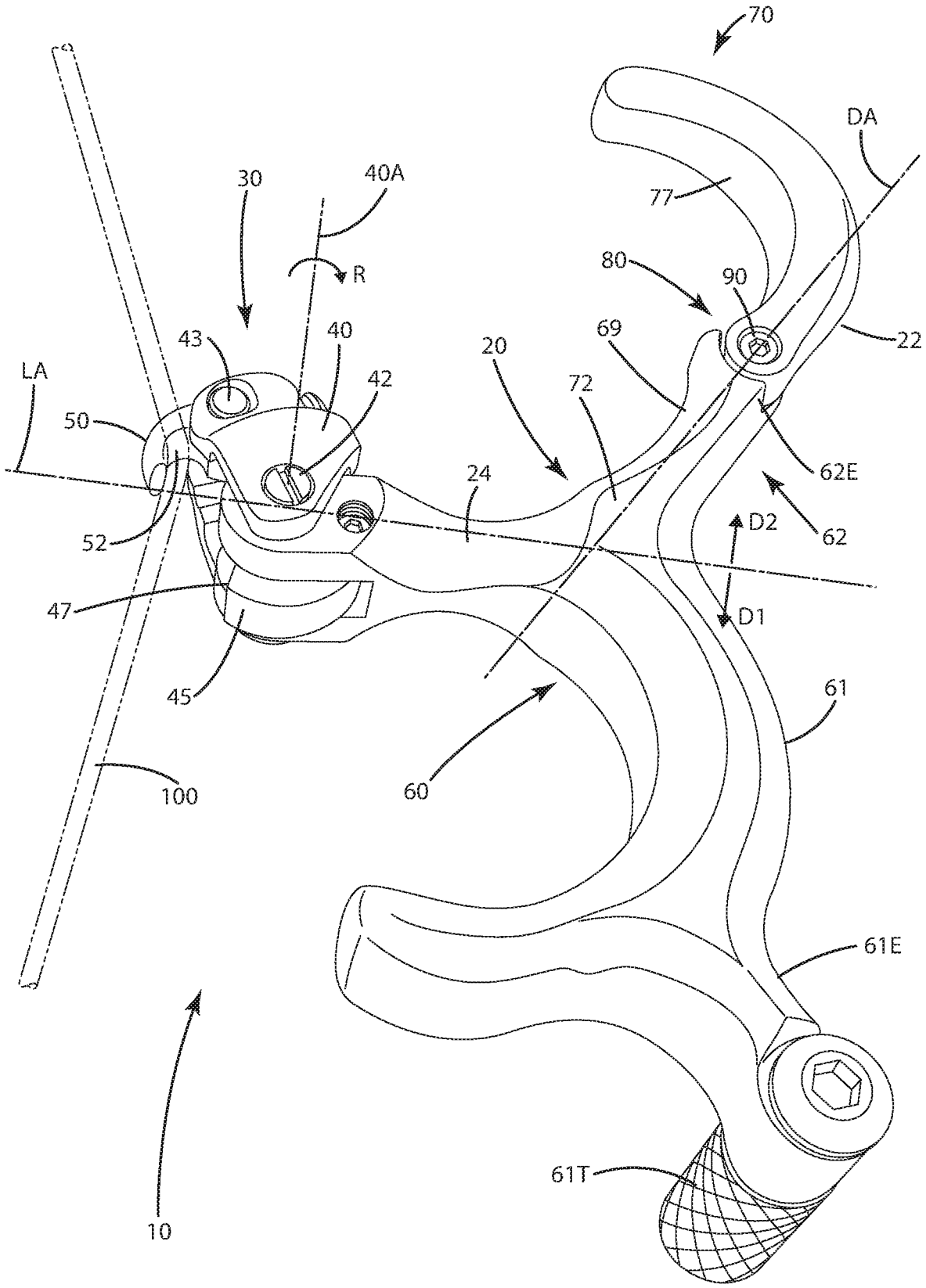
FIG. 1 is an upper perspective view of the archery release of a current embodiment engaged with a bowstring.

A current embodiment of the archery release is shown in FIGS. 1-4 and generally designated 10. The release 10 is in the form of a hand held release, in particular a back tension release; however, the current embodiment can be utilized with a variety of different types of releases, for example, thumb releases, plunger releases, pinky releases, rope releases, and other types of handheld releases modified as described herein to be tethered to a wrist strap. The back tension release 10 can include a release body 20 joined with a release head 30, which can include a hood 40, a hook or sear 50 and a pawl 45. The release 10 can include an arm 24, which can extend between an archer's digits and can form a portion of a release body 20, which can further include a handle 60. The handle can include a primary portion 61 and one or more adjustable finger or digit extensions 70 joined with a secondary portion 62. The finger extension 70 can be selectively adjusted and reoriented relative to the secondary portion 62 as described below to better fit certain preferences or the stature of an archer using the release 10.

The release can be used to assist the archer in drawing and releasing the bowstring 101. When the release 10, as shown in FIG. 1, is used to draw the bowstring 100, the bowstring 100 is captured by the hook or sear 50 in a bowstring notch 52. As the archer draws the bowstring, the sear 50 remains engaged the bowstring 100. After being drawn, the archer moves or rotates the handle 60 to rotate about the axis 40A, which can be aligned with the axle 42, in direction R, by tensing the archer's back muscles, which translates to pulling on part of the handle. When such movement occurs, the sear moves relative to the pawl 45 until the sear disengages the same. Upon such a disengagement, the sear 50 is free to rotate, and thus release the bowstring 100 from the bowstring notch 52 of the sear, thereby shooting the bow with which the release is used.

As used herein, bowstring refers to an actual bowstring of an archery bow and any device or component adapted to join with a bowstring of an archery bow and aid an archer in drawing or releasing the bowstring, including rope loops, which are attached to the bowstring above and below the location where an arrow nock rests, and receivers, for example, a metal loop or partial loop that is joined with the bowstring above and below, or only above, or only below the location where the arrow nock rests on the bowstring. Further, as used herein, archery bow refers to any compound bow, recurve bow, long bow, crossbow or any other device that propels or is capable of propelling an arrow, bolt or other similar projectile.

Referring to FIGS. 1-4 the components of the release 10 will now be described in detail. The release 10 can include a release body 20, which can include a handle 60. The handle can define multiple grooves or recesses designed to accommodate one or more digits of a user. Optionally, the handle can be a straight bar or other suitable gripping structure to enable a user to grasp the release body 20.

As shown in FIG. 1, an arm 24 can extend toward the release head 30 from the handle 60. The arm 24 can be an integral or separate from the handle 60 and remainder of the body 20. The handle 60 can include a primary handle portion 61 and the secondary handle portion 62, extending on opposite sides of the arm 24, in opposite directions D1 and D2. With the arm so positioned relative to the primary and secondary handle portions, the arm is configured to extend and fit between a user's digits when the handle is held in the user's hand, for example, between an archer's pointer finger and a ring finger. Optionally, the primary handle portion 61 can extend to support a pointer finger of an archer, wrapping partially or fully around and archer's pointer finger when in use. Further optionally, the primary handle portion 61 can include an extension 61E to which a thumb peg 61T is joined. This thumb peg can be held and/or actuated by an archer's thumb during a draw cycle.

As shown in FIG. 1, the release head 30 can include a hood 40. This hood 40 can be in the form of a channel-shaped member that straddles an end of the release arm 24 and/or release body 20. The hood 40 can be secured via a first axle 42 to the arm, and can freely rotate about the axle. At the opposite end of the hood 40, a sear axle or pin 43 can be located. A hook or sear 50 can be rotatably mounted to a sear axle or pin 43 so that the sear 50 can rotate about a sear axis. The sear or hook 50 can be constructed to define a bowstring notch 52 which directly engages the bowstring of an archery bow. The bowstring notch can include a curvilinear, planar or other smooth surface configured to minimize wear on a bowstring. The bowstring notch can be a U or V shaped opening or recess configured to capture at least a portion of the bowstring.

The sear 50 can include a sear engagement edge (not shown) which can be in the form of a polished or extremely smooth and optionally planar surface that is adapted to selectively and slidably engage the pawl 45, which itself can be polished or extremely smooth, and optionally curvilinear. If desired, the sear 50 can be selectively tensioned or biased to a preselected configuration with a rubber band or other biasing element.

The pawl 45 can be attached to the arm 24 and the release body 20 with the locking axle pin 42. The pawl 45 can be in the form of a partial moon pawl including a rounded or curvilinear pawl engagement surface and a chordal planar surface 47. The curvilinear pawl engagement surface can be configured so that the sear moves and or slides along the curvilinear engagement surface during a portion of the draw cycle with the release. Optionally, the pawl can be in the form of a truncated or D-shaped disc. Further optionally, the pawl can include a shoulder (not shown) so that the sear edge drops into this shoulder after sliding along the curvilinear pawl engagement surface to produce an audible click right before the sear edge disengages the moon pawl to release the release. The moon pawl 45 can be adjustable so that the precise degree of rotation of the chordal planar surface 47 can be adjusted to effectively set the release point of the release, at which point, the sear disengages the pawl and releases the bowstring from the release. This can enable an archer to adjust the sensitivity of the release to their preference.

With reference to FIGS. 1-4, the handle 60 and finger extension 70 will be described in further detail. As mentioned above, the secondary handle portion 62 can extend outward and away from the arm 24 and the primary handle portion 61, generally on the opposite side of the longitudinal axis of the arm 24 and body 20 from the primary handle portion. Primary handle portion 61 can extend laterally away from the arm in direction D1 from the longitudinal axis LA of the arm. The secondary portion 62 can extend laterally away from the arm 24 in a second direction D2 opposite the first direction D1. The secondary portion 62 can include a secondary portion end 62.

Figure 2:
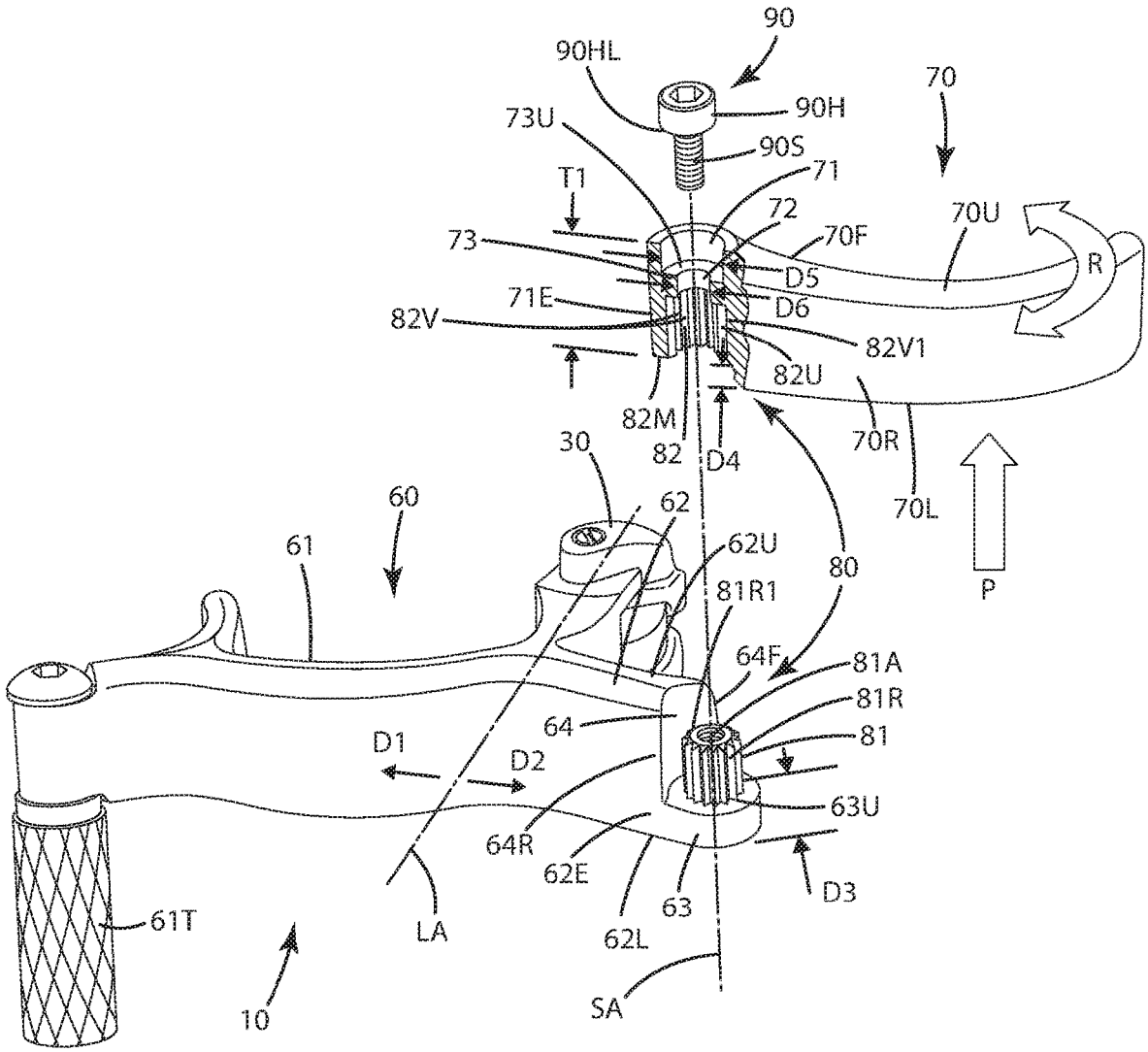
FIG. 2 is an exploded perspective view of the archery release with a finger extension in an adjustment mode, removed from a handle portion of the release with an exposed spline connection.
Figure 4:
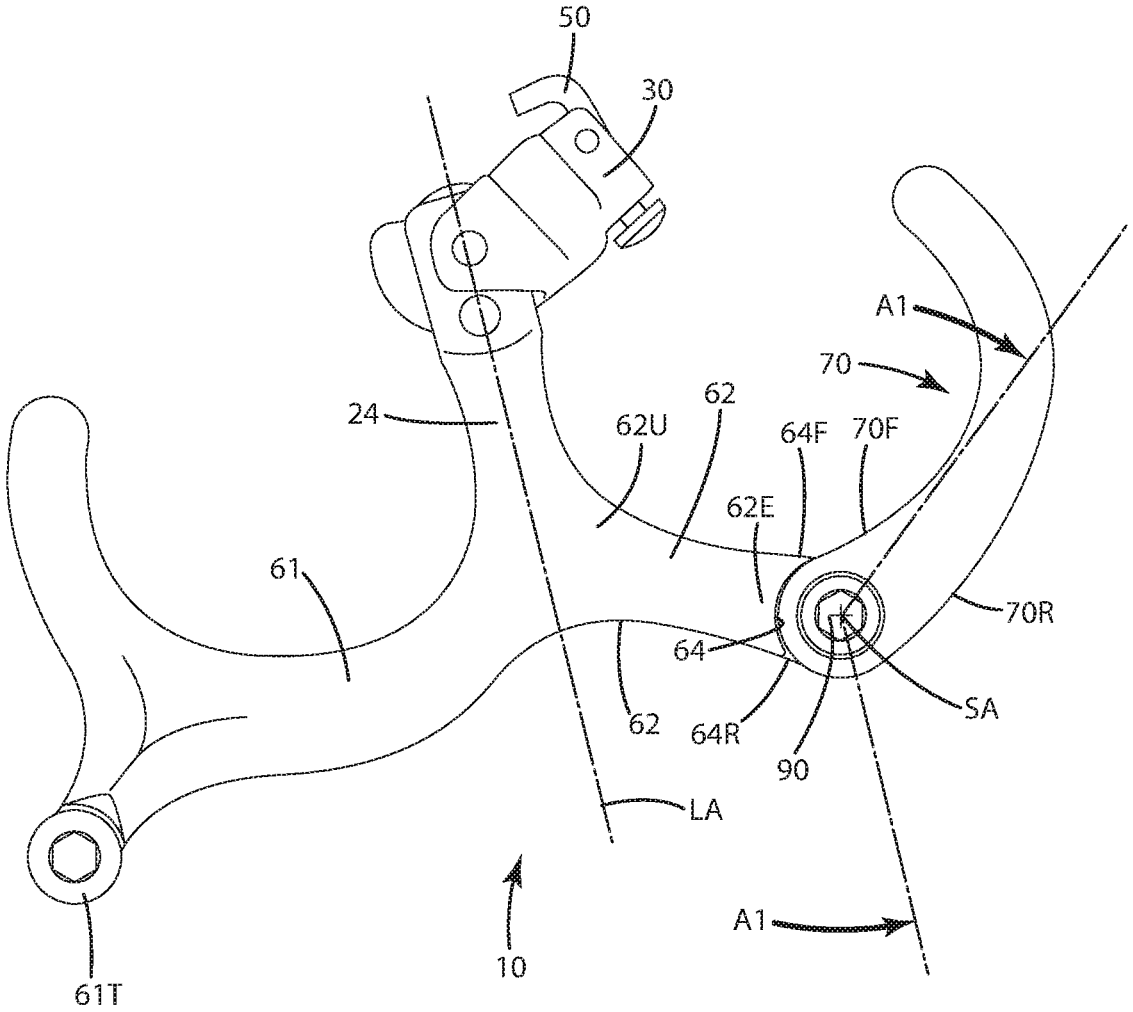
FIG. 4 is a top view of the release with the finger extension in a rearward setting, in another registration mode and locked mode.

As shown in FIGS. 2 and 4, the secondary portion end 62 can be joined with the digit extension 70 via the spindle connection 80. FIG. 1 shows the digit extension 70 in a fixed non-rotatable orientation relative to the secondary portion, and a secondary portion end in particular, in a registration mode. In this configuration, with the fastener 90 also installed, the digit extension further can be in a secured mode or locked mode. FIG. 2, however, shows the digit extension 70 in an adjustment mode, with the finger extension 70 removed from the second portion 62 and the second portion end 62E, with the parts of the spindle connection 80 disassociated from one another as described below.

The secondary portion and in particular the secondary portion end 62E can include a base 63 extending outwardly from a transition wall 64. The transition wall 64 can extend downward from an upper surface 62U of the second portion 62. The base can extend upward from a lower surface 62L of the secondary portion 62. The base 63 can be generally perpendicular to the transition wall 64, and can extend farther from the end 62E than the remainder of the secondary portion. In this manner, the upper surface 62U can extend farther from the arm longitudinal axis LA than the lower surface 62L of the secondary portion 62.

Figure 3:
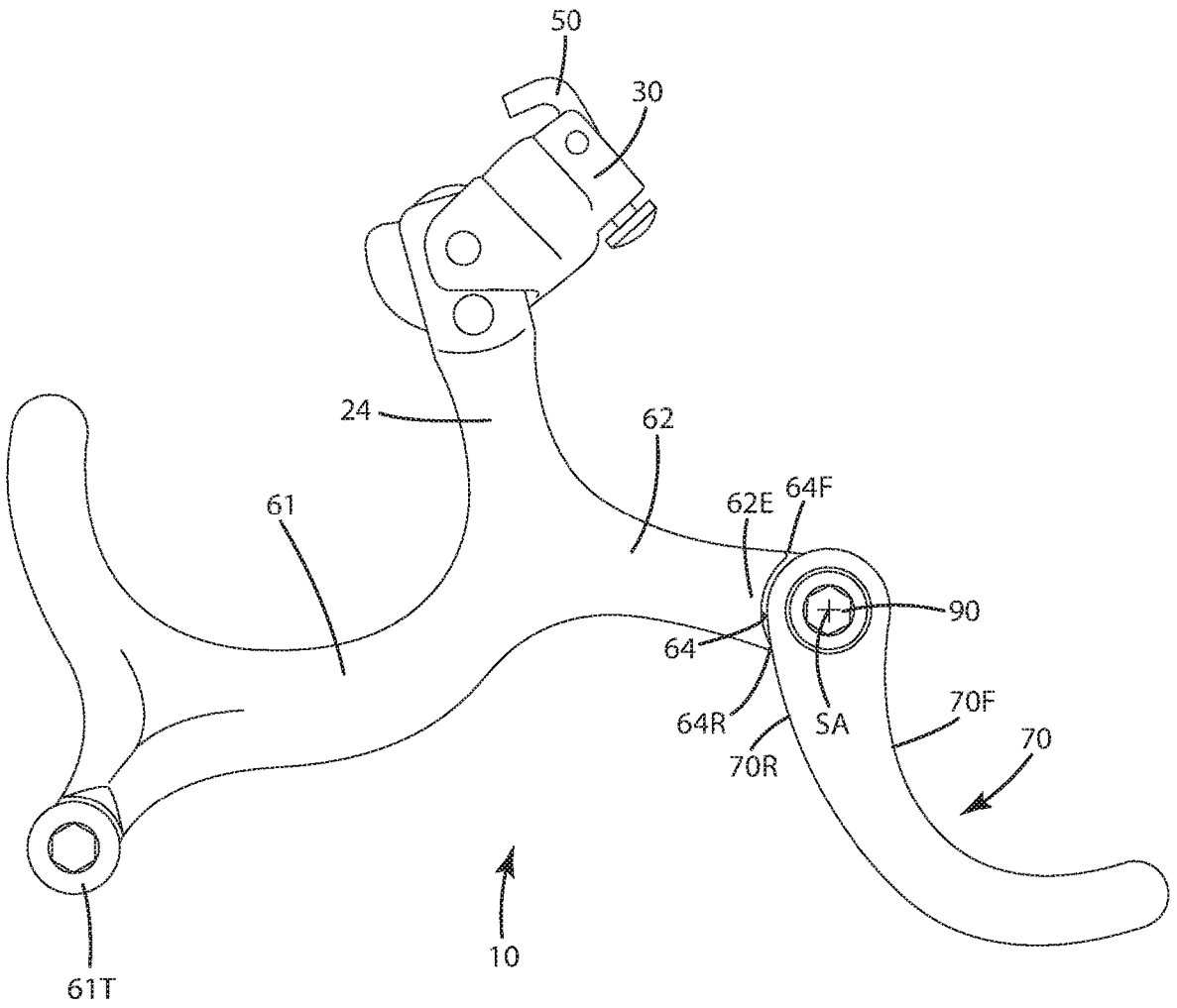
FIG. 3 is a top view of the release with the finger extension in a forward setting, also in a registration mode and a locked mode.

With reference to FIG. 2, the base 63 can include an upper surface 63U that is distal from the lower surface 62L of the secondary portion 62. The transition wall 64 can include a forward stop engagement surface 64F and a rearward stop engagement surface 64R. As described below, and as shown in FIG. 4, a forward wall 70F of the digit extension 70 can engage the forward stop engagement 64F to limit forward positioning of the digit extension 70 relative to the spindle connection 80 in the adjustment mode. As shown in FIG. 3, a rearward wall 70R of the digit extension 70 is configured to engage the rearward stop engagement 64R to limit a rearward positioning of the digit extension 70 relative to spindle connection 80 in the adjustment mode. As described further below, this can limit the angular range of adjustment of the digit extension 70 relative to the handle 60 and in particular the secondary portion 62.

With reference to FIG. 2, a spindle post 81 can project upwardly from the base 63 and generally from the upper surface 63U of the base. The spindle post 81 can extend upward from the base adjacent the transition wall 64. The spindle post 81 can also include a spindle longitudinal axis SA that extends upward, generally parallel to the transition wall as well. Of course, in some cases, the spindle wall and spindle axis SA can be offset at some optional angle relative to one another so the finger extension can be disposed in varying angles relative to the handle 60, in particular, the secondary portion 62.

The spindle post 81 can be configured to include multiple ridges 81R. These ridges can be evenly spaced about the spindle post, generally around the spindle longitudinal axis SA. The ridges can be triangular, polygonal, rounded, convex or other shapes or configurations. Generally there can be optionally 10 to 30, 20 to 30, 15 to 25, or 5 to 20 of these ridges, and a corresponding number of valleys 82V in the spindle recess 82. The valleys 82B can be disposed in the spindle recess 82, which itself can be defined at least partially in the finger extension 70. This recess 82 can be defined generally extending upward from the lower surface 70L of the finger extension 70 toward the upper surface 70U. Optionally, the spindle recess 82 extends less than half the thickness T1 of the finger extension 70 from the lower surface 70L to the upper surface 70U. In other cases, the spindle recess 82 can extend about ¼, ⅓, ½, ⅔, or ¾ the thickness T1 of the finger extension 70.

Each of the spindle post 81 and the spindle recess 82 can be of a cylindrical, polygonal and/or multi-pointed star shape. In some cases, the recess and spindle post can have a polygon cross-section, such as a triangle, a rectangle, a hexagon, an octagon, a decagon or other shapes. Generally the ridges of the spindle post can correspond to the corners or vertices of each of the different surfaces of the respective shapes. Likewise, the valleys can correspond to those corresponding corners or vertices of each of the different surfaces of the respective shapes. Optionally, each of the respective vertices are ridges can extend radially outward from the spindle longitudinal axis SA. Some ridges can extend toward the transition wall, while others can extend outward, away from the transition wall.

As shown in FIG. 2, the base 63 can extend upward a distance D3 from the lower surface 62L of the secondary portion 62. The spindle recess 82 also can be defined in and spaced a distance D4 from the lower surface 70L of the finger extension 70. The distances D3 and D4 can be substantially equal to or slightly greater or less than one another. The spindle recess 82 can be defined in the finger extension 70. The spindle recess 82 can extend upward from a mating surface 82M. This mating surface 82M can be configured so that in the registration mode, it is immediately adjacent and/or directly engaging the base upper surface 63U. In other cases, it may be spaced a small gap from that base upper surface when the digit extension 70 is fully registered and installed or locked relative to the handle 60.

The spindle recess 82 can include the plurality of valleys 82 which are configured to slidably receive the plurality of ridges 81. The valleys can include the same shapes, configurations and orientations as each of the respective ridges 81. Of course, the plurality of ridges are removable from the plurality of valleys in the adjustment mode such that the extension 70 can be removed, replaced and/or rotated relative to the secondary portion end 62E, to adjust the finger extension and pursue the archer's preference with regard to the orientation of the finger extension 70 relative to the remainder of the handle.

As shown in FIG. 2, the finger extension 70 can define a first recess 71 having a first diameter D5 and a first aperture 72 having a second diameter D6. The second diameter D6 can be less than the first diameter D5. The first recess 71 can extend downward from the upper surface 70U of the digit extension 70. The first aperture 72 can further extend downward, below the first recess 71. The first aperture 72 can transition to and be in communication with the spindle recess 82, generally opening into that spindle recess. In some cases, the second diameter, and that region of the extension surrounding it, can be threaded.

The first extension also can include a shoulder 73 that is disposed at the bottom of the first recess 71. That first recess can be selectively configured to receive a head 90H of the fastener 90 that is part of the spindle connection 80. The fastener can include a fastener shaft 90S that is optionally threaded. The fastener head 90H can include a drive feature that enables a user to insert a tool and rotate the fastener 90. The aperture 72 can be configured to receive the shaft 90S of the fastener 90. The head 90H of the fastener can be configured to engage the shoulder 73 to secure the spindle post 81 in the spindle recess 82, or generally to secure the digit extension in a locked mode or secured mode to the secondary portion and the handle 60 in general. Optionally, the fastener head 90H can include a lower surface 90HL that directly engages and upper surface 73U of the shoulder when the fastener 90 is sufficiently installed and/or tightened.

As also shown in FIG. 2, the spindle post 81 can include an aperture 81A. This aperture 81A can threadably receive the shaft 90S of the fastener 90 when the fastener is installed relative to the first recess 71, first aperture 72, spindle recess 82 and the aperture 81A. In the registration mode, the fastener 90 can extend at least partially through the digit extension 70 and into the secondary portion 62 to secure the digit extension 70 to the secondary portion. More particularly, the fastener 90 can be installed such that the fastener head 90H engages the shoulder and is disposed within the first recess 71. The shaft 90S of the fastener can extend through the first hole 72 and into the spindle post aperture 81A in which it is threadably received. The fastener 90, in particular, the threaded shaft 90S, therefore extends simultaneously within the spindle recess and the spindle post when the digit extension is in the registration mode. When the fastener is fully installed, the digit extension is configured so that the ridges 81R are registered with the valleys 82V in a registration mode in which the digit extension is in a fixed, non-rotatable orientation relative to the secondary portion 62. The fastener also can further secure and lock the digit extension 70 relative to the secondary portion 62 so that the digit extension and spindle recess cannot be slid off the spindle post 81. Optionally, when the fastener is not installed, but the digit extension is installed such that the spindle post 81 is within the spindle recess 82, the corresponding elements such as the ridges and valleys interlock and/or nest within one another so that the digit extension 70 cannot be rotated or turned about spindle longitudinal axis SA. The digit extension is in a fixed, non-rotatable orientation relative to the secondary portion 62.

With reference to FIGS. 1 and 2, the operation of the digit extension 70 in a registration mode and an adjustment mode can be further understood. In the registration mode, shown in FIG. 1, the digit extension 70 is joined with the secondary portion 62 of the handle 60 in a fixed, non-rotatable manner. The plurality of ridges 81R of the spindle post are nested in and interlock with the corresponding plurality of valleys 82V of the spindle recess. The fastener 90 is also installed so that the extension also is in a locked mode during the registration mode so that the digit extension cannot be removed relative to the handle 60.

In the adjustment mode, the fastener 90 initially can be removed from the spindle connection 80. For example, the fastener 90 can be unthreaded from the spindle post aperture 81A, out from the spindle post 81 and the spindle recess 82, out through the first aperture 72 and out from the first recess 71. The fastener 90 can be removed from the digit extension completely. In this initial part of the adjustment mode, with the fastener removed, but the spindle post still engaging the spindle recess, the digit extension 70 still is fixed and non-rotatable relative to the secondary portion and generally relative to the handle. This is because the ridges interlock with the respective valleys.

Further, into the adjustment mode, shown in FIG. 2, the digit extension 70 can be moved in direction P such that the spindle ridges slide relative to a first set of valleys and vice versa. Thus, the digit extension 70 and recess 82 slides upward and off the spindle post 81 such that the digit extension becomes dissociated from and removed relative to the remainder of the handle 60. In the adjustment mode, when the spindle post is removed from the spindle recess, lower ends of the valleys 82V are located above the upper ends of the ridges 81R so that the valleys can be reoriented or moved relative to the ridges. The digit extension 70 can be moved in directions R such that the angular orientation of the extension longitudinal axis DA can be changed relative to the arm longitudinal axis LA. In this manner, the digit engagement surface and or finger groove 77 can be reoriented relative to the remainder of the secondary portion 62 and the other adjacent finger groove 69 and/or the secondary portion 62. The precise movement or rotation in directions R can be selected based on the archer's preference.

After the finger extension 70 is rotated satisfactorily, the digit extension 70 can be oriented such that the spindle recess 82 aligns with the spindle post 81. The ridges 81R are registered within and can be slid in or relative to a different set of valleys 82V, rotatably offset about the spindle axis from the first set of valleys (to change the orientation of the finger extension relative to the handle) as the digit extension generally moves along the spindle axis SA until the digit extension is satisfactorily seated on the spindle post. The valleys 82V can slide vertically and parallel relative to the spindle axis SA. Optionally, the bottom surface 82M can engage the upper surface 63U of the base 63. After this placement, the digit extension 70 is fixed and non-rotatable relative to the handle due to the interaction of the ridges and valleys. After this connection is made, the digit extension 70 is in the registration mode. The fastener 90 can be installed such that the digit extension is further in the locked mode, with the fastener extending through the first recess 71, the first aperture 72 and into the spindle post aperture 81A. The head 90H of the fastener can engage the shoulder 73 to tighten down the digit extension relative to the handle.

As shown in FIGS. 2, 3 and 4, the handle 60 can include a forward stop 64F and a rearward stop 64R as described below. With reference to FIG. 4, the digit extension 70 can be adjusted forwardly until the forward wall 70F engages the forward stop 64F at which point, the spindle post cannot be inserted in the spindle recess. This effectively can limit the forward placement of the digit extension relative to the secondary portion. Likewise, referring to FIG. 3, the digit extension 70 can be adjusted rearwardly until the rearward wall 70R engages the stop 64R, at which point the spindle post cannot be inserted in the spindle recess. This effectively can limit the rearward placement of the digit extension relative to the secondary portion. These forward and rearward stops 64F and 64R can be positioned so that they engage the respective forward and rearward walls of the digit extension to limit placement of the digit extension to an angular range A1. Optionally, this angular range about the spindle longitudinal axis can be less than 270°, less than 260°, less than 250°, less than 240°, less than 230°, less than 220°, less than 210°, less than 200°, less than 190°, less than 180°, less than 170°, less than 160°, less than 150°, less than 140°, less than 130°, less than 120° or less than 90°, depending on the application.

Optionally, the ridges and valleys can be configured in a particular number and orientation to limit the discrete orientations of the digit extension relative to the handle in the registration mode. For example, the number and/or size of the ridges and valleys optionally can be selected to enable the digit extension to be placed in optionally 5 to 12, 5 to 15, 5 to 20, 7 to 12, or 7 to 10 discrete orientations relative to the handle in the registration mode. With these various orientations of the digit extension relative to the remainder of the handle, and in particular the secondary portion, the spindle connection is configured to allow the digit extension to form a single digit recess with a handle and arm in a first registration mode. In other configurations, the spindle connection is configured so that the digit extension forms a second digit recess adjacent a first digit recess 69, adjacent the arm 24, in a second registration mode. An example of the second registration mode is shown in FIG. 1, and an example of the first registration mode is shown in FIG. 4.

In some cases, the stops 64R and 64F prevent certain ones of the ridges and valleys from ever engaging one another. For example, the ridges 81R can include a first set of ridges 81R1 that generally face toward the transition wall 64. The recesses 82V can include a first set of valleys 82V1 that are disposed farthest from the end 71E of the digit extension 70. With the stops configured as they are, the digit extension is not allowed to rotate sufficiently such that the first set of ridges 81R1 ever engage the first set of valleys 82V1 in the adjustment mode and/or the registration mode because the digit extension simply cannot be joined with the handle due to the interference of the forward or rearward walls with a respective forward stop 64F and rearward stop 64R. Thus, these stops can engage these walls to prevent the first ridges from ever engaging the first valleys in the registration mode and/or adjustment mode. Indeed, if these first sets of ridges and valleys are aligned with one another, the spindle post 81 cannot be inserted into the spindle recess 82, and moreover, the digit extension cannot be joined with the handle. Further optionally, these forward and rearward stops can be arranged to prevent the digit extension 70 from being configured to extend in the first direction D1.

Figure 5:
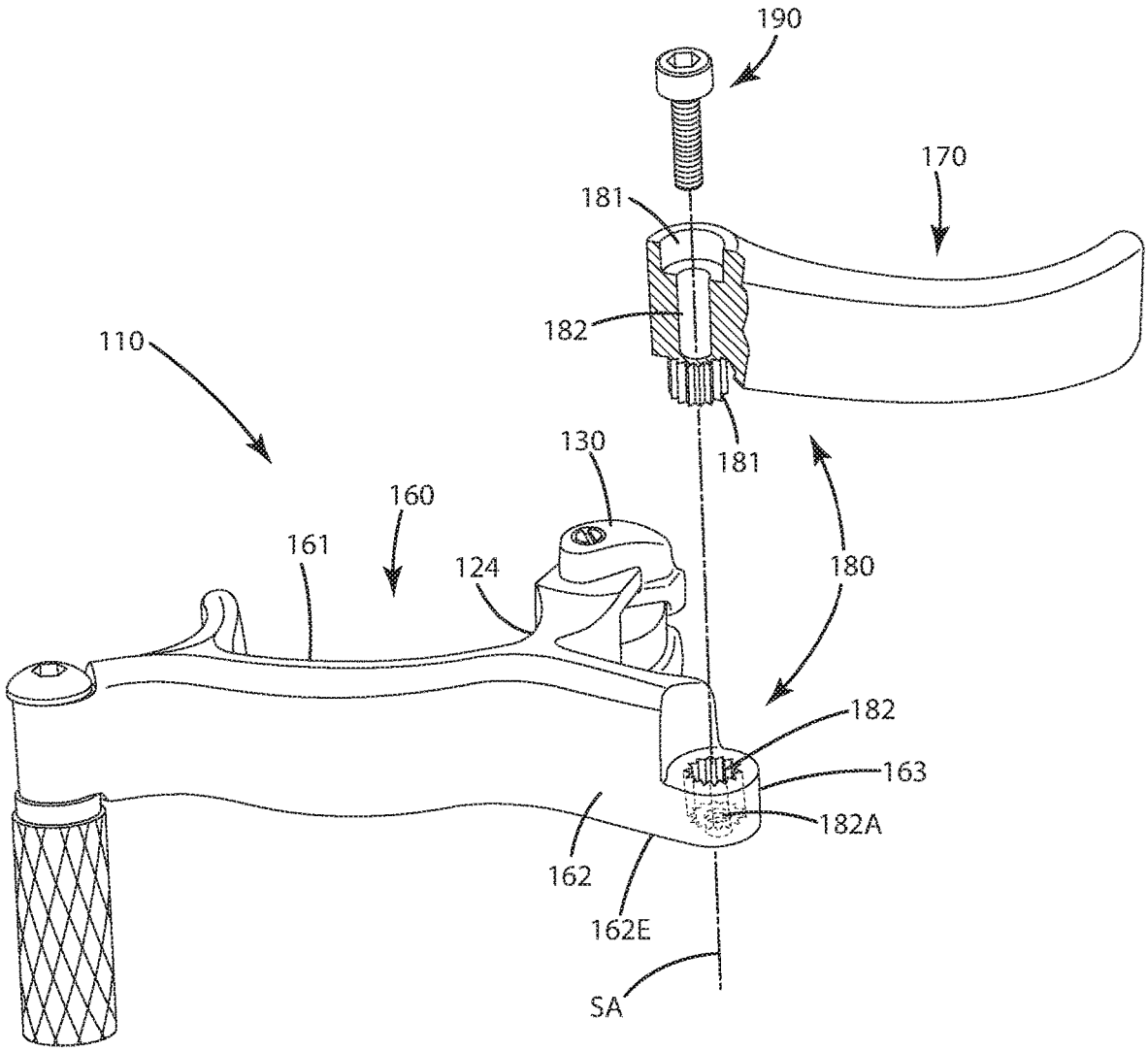
FIG. 5 is an exploded perspective view of the archery release of a first alternative embodiment in an adjustment mode.

A first alternative embodiment of the release is shown in FIG. 5 and generally designated 110. This release 110 is similar in structure, function and operation to the release described above with several exceptions. For example, this release 110 can include a release head 130 joined with an arm 124 that connects to a handle 160. The handles 160 can include a primary portion 161 and a secondary portion 162. In this embodiment, the secondary portion 162 can be joined with a digit extension 170 via a spindle connection 180. The spindle connection 180 can be operable in a registration mode and an adjustment mode. In this embodiment, however, the spindle post 181 can be associated with the digit extension 170, while the spindle recess 182 can be associated with the secondary portion end 162E. The spindle recess 22 can be defined in the base 163 and can include a plurality of valleys. The spindle post 181 can extend from a lower surface of the digit extension. A fastener 190 also can be included to secure the digit extension 170 to the secondary portion 162. The fastener 190 can extend through a first recess 181, a first aperture 182 that also extends through the spindle post 181, and to a base aperture 182A that is threaded. The fastener 190 can secure the digit extension 170 in a locked mode, while in the registration mode, similar to the embodiment described above.

The components of the releases herein, for example, the handle, the release head and their parts can be constructed from a variety of materials, for example, metal, such as steel, stainless steel and aluminum, as well as other synthetic materials such as polymers, and any combination of the foregoing. Further, the releases and components can be treated with special processes, for example, anodizing, dipping or filming to provide the release and its components with a desired finish and appearance. In general, components of the releases, such as the release head, first adjuster and adjuster linking element can be molded, machined and/or extruded to obtain their desired configuration. These components can also be treated with special processes as described above to provide a desired finish.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery release comprising:

a release head including a sear defining a bowstring notch configured to engage a bowstring;

an arm extending rearward from the release head and configured to fit between adjacent fingers of a user, the handle including a distal portion joined with the release head and a proximal portion;

a handle joined with the proximal portion, the handle including a primary portion and a secondary portion, the primary portion extending laterally away from the arm in a first direction, the secondary portion extending laterally away from the arm in a second direction opposite the first direction, the secondary portion including a secondary portion end;

a digit extension joined with the secondary portion end and extending from the secondary portion end to extend a length of the handle in the second direction; and a spindle connection joining the secondary portion end and the digit extension, the spindle connection including a spindle post having a plurality of ridges radially projecting from the spindle post about a spindle longitudinal axis, and a spindle recess having a plurality of valleys configured to receive corresponding ones of the plurality of ridges, wherein the digit extension is moveable relative to the secondary portion end so that the plurality of ridges can be removed from the plurality of valleys and rotated relative to the spindle longitudinal axis in an adjustment mode, and so that the plurality of ridges can be registered with the plurality of valleys in a registration mode in which the digit extension is in a fixed, non-rotatable orientation relative to the secondary portion, wherein the secondary portion end includes a base and a transition wall extending upward from the base, wherein the spindle post extends upward from the base adjacent the transition wall.

2. The archery release of claim 1, wherein the spindle connection includes a fastener that extends through the digit extension and into the secondary portion end to secure the digit extension to the secondary portion.

3. The archery release of claim 2, wherein the digit extension includes a first recess having a first diameter and a first aperture having a second diameter in communication with the first recess, wherein the second diameter is less than the first diameter.

4. The archery release of claim 3, wherein a shoulder is disposed at the bottom of the first recess, wherein the first recess is configured to receive a head of the fastener, wherein the second recess is configured to receive a shaft of the fastener, wherein the head of the fastener is configured to engage the shoulder to secure the spindle post in the spindle recess.

5. The archery release of claim 1, wherein the longitudinal axis extends upward generally parallel to the transition wall.

6. The archery release of claim 1, wherein the plurality of ridges are slidable relative to the plurality of valleys in a direction parallel to the longitudinal axis in the adjustment mode so that the spindle recess can be slid off the spindle post.

7. An archery release comprising:

a release head including a sear defining a bowstring notch configured to engage a bowstring;

an arm extending rearward from the release head and configured to fit between adjacent fingers of a user, the handle including a distal portion joined with the release head and a proximal portion;

a handle joined with the proximal portion, the handle including a primary portion and a secondary portion, the primary portion extending laterally away from the arm in a first direction, the secondary portion extending laterally away from the arm in a second direction opposite the first direction, the secondary portion including a secondary portion end;

a digit extension joined with the secondary portion end and extending from the secondary portion end to extend a length of the handle in the second direction;

a spindle connection joining the secondary portion end and the digit extension, the spindle connection including a spindle post having a plurality of ridges radially projecting from the spindle post about a spindle longitudinal axis, and a spindle recess having a plurality of valleys configured to receive corresponding ones of the plurality of ridges, and a transition wall disposed adjacent the secondary portion end, the transition wall including a forward stop engagement and a rearward stop engagement, wherein the digit extension is moveable relative to the secondary portion end so that the plurality of ridges can be removed from the plurality of valleys and rotated relative to the spindle longitudinal axis in an adjustment mode, and so that the plurality of ridges can be registered with the plurality of valleys in a registration mode in which the digit extension is in a fixed, non-rotatable orientation relative to the secondary portion, wherein a forward wall of the digit extension is configured to engage the forward stop engagement to limit a forward positioning of the digit extension relative to the spindle connection in the adjustment mode, wherein a rearward wall of the digit extension is configured to engage the rearward stop engagement to limit a rearward positioning of the digit extension relative to the spindle connection in the adjustment mode.

8. The archery release of claim 7, wherein the forward stop engagement and rearward stop engagement are arranged to prevent the digit extension from being configured to extend in the first direction.

9. An archery release comprising:

a release head including a sear defining a bowstring notch configured to engage a bowstring;

an arm extending rearward from the release head and configured to fit between adjacent fingers of a user, the handle including a distal portion joined with the release head and a proximal portion;

a handle joined with the proximal portion, the handle including a primary portion and a secondary portion, the primary portion extending laterally away from the arm in a first direction, the secondary portion extending laterally away from the arm in a second direction opposite the first direction, the secondary portion including a secondary portion end;

a digit extension joined with the secondary portion end and extending from the secondary portion end to extend a length of the handle in the second direction; and a spindle connection joining the secondary portion end and the digit extension, the spindle connection including a spindle post having a plurality of ridges radially projecting from the spindle post about a spindle longitudinal axis, and a spindle recess having a plurality of valleys configured to receive corresponding ones of the plurality of ridges, wherein the digit extension is moveable relative to the secondary portion end so that the plurality of ridges can be removed from the plurality of valleys and rotated relative to the spindle longitudinal axis in an adjustment mode, and so that the plurality of ridges can be registered with the plurality of valleys in a registration mode in which the digit extension is in a fixed, non-rotatable orientation relative to the secondary portion, wherein the spindle post extends from a base on the secondary portion end, wherein the spindle recess is defined by the digit extension, wherein a fastener extends through an end of the digit extension and into the spindle post in the registration mode, wherein the handle includes a stop that prevents first ones of the plurality of valleys from engaging any of first ones of the plurality of ridges in the adjustment mode.

10. An archery release comprising:

a handle including a forward extending arm joined with a release head having a pivotal sear defining a bowstring notch;

a digit extension selectively, adjustably joined with the handle via a spindle connection, the spindle connection including a spindle post having a plurality of ridges and a spindle recess having a plurality of valleys configured to receive corresponding ones of the plurality of ridges, wherein the plurality of ridges can be removed from a first set of the plurality of valleys and rotated relative to a spindle longitudinal axis in an adjustment mode, wherein the plurality of ridges can be registered with a different set of ones of the plurality of valleys in a registration mode in which the digit extension is in a fixed, non-rotatable orientation relative to the handle, wherein the spindle post is non-rotatable relative to the spindle recesses when the plurality of ridges are registered in the plurality of valleys, wherein at least one of the handle and the digit extension includes a stop, wherein at least one of the handle and the digit extension includes a wall, wherein the stop engages the wall to limit placement of the digit extension to an angular range of less than 270 degrees about a longitudinal axis of the spindle connection.

11. The archery release of claim 10, wherein the plurality of ridges include a first ridge, wherein the plurality of valleys includes a first valley, wherein at least one of the handle and the digit extension includes a stop, wherein at least one of the handle and the digit extension includes a wall, wherein the stop engages the wall to prevent the first ridge from ever engaging the first valley in the registration mode.

12. The archery release of claim 10, wherein the spindle connection is configured to enable the digit extension to be placed in 5 to 12 discrete orientations relative to the handle in the registration mode.

13. The archery release of claim 12, wherein the spindle connection is configured so that the digit extension forms a single digit recess with the handle and the arm in a first registration mode, wherein the spindle connection is configured so that the digit extension forms a second digit recess adjacent a first digit recess adjacent the arm in a second registration mode.

14. An archery release comprising:

a handle including a forward extending arm joined with a release head having a pivotal sear defining a bowstring notch; and a digit extension selectively, adjustably joined with the handle via a spindle connection, the spindle connection including a spindle post having a plurality of ridges and a spindle recess having a plurality of valleys configured to receive corresponding ones of the plurality of ridges, wherein the plurality of ridges can be removed from a first set of the plurality of valleys and rotated relative to a spindle longitudinal axis in an adjustment mode, wherein the plurality of ridges can be registered with a different set of ones of the plurality of valleys in a registration mode in which the digit extension is in a fixed, non-rotatable orientation relative to the handle, wherein the spindle post is non-rotatable relative to the spindle recesses when the plurality of ridges are registered in the plurality of valleys, wherein the spindle post extends from a base of the handle, wherein the spindle recess is defined by the digit extension, wherein a fastener extends through an end of the digit extension and into the spindle post in the registration mode, wherein the handle includes a stop that prevents first ones of the plurality of valleys from engaging any of first ones of the plurality of ridges in the adjustment mode.

15. An archery release comprising:

a handle including an arm that extends to a release head having a sear with a bowstring notch, the handle including a handle end;

a digit extension adjustably joined with the handle;

a spindle connection joining the handle and digit extension, the spindle connection including a spindle post having a plurality of ridges and a spindle recess having a plurality of valleys configured to receive corresponding ones of the plurality of ridges to prevent rotation of the digit extension relative to the handle in a registration mode; and a transition wall disposed adjacent the handle end, the transition wall including a forward stop engagement and a rearward stop engagement, wherein a forward wall of the digit extension is configured to engage the forward stop engagement to limit a forward positioning of the digit extension relative to the spindle connection in an adjustment mode, wherein a rearward wall of the digit extension is configured to engage the rearward stop engagement to limit a rearward positioning of the digit extension relative to the spindle connection in the adjustment mode.

16. The archery release of claim 15 comprising:

a fastener extending at least partially through the digit extension and the handle end to secure the digit extension to the handle end.

17. The archery release of claim 16, wherein the digit extension includes a first recess having a first diameter and a first aperture having a second diameter in communication with the first recess, wherein the second diameter is less than the first diameter, wherein a shoulder is disposed at the bottom of the first recess, wherein the first recess is configured to receive a head of the fastener, wherein the second recess is configured to receive a shaft of the fastener, wherein the head of the fastener is configured to engage the shoulder to secure the spindle post in the spindle recess.

18. An archery release comprising:

a handle including a forward extending arm joined with a release head having a pivotal sear defining a bowstring notch; and a digit extension selectively, adjustably joined with the handle via a spindle connection, the spindle connection including a spindle post having a plurality of ridges and a spindle recess having a plurality of valleys configured to receive corresponding ones of the plurality of ridges, wherein the plurality of ridges can be removed from a first set of the plurality of valleys and rotated relative to a spindle longitudinal axis in an adjustment mode, wherein the plurality of ridges can be registered with a different set of ones of the plurality of valleys in a registration mode in which the digit extension is in a fixed, non-rotatable orientation relative to the handle, wherein the spindle post is non-rotatable relative to the spindle recesses when the plurality of ridges are registered in the plurality of valleys, wherein the spindle connection is joined with a base, wherein a transition wall is disposed adjacent the spindle connection and the base, wherein the transition wall includes a stop engagement, wherein the stop engagement engages at least one of the handle and the digit extension to limit positioning of the digit extension relative to the handle in the adjustment mode.

* * * * *